US006280344B1

(12) United States Patent
Robb

(10) Patent No.: US 6,280,344 B1
(45) Date of Patent: Aug. 28, 2001

(54) LUMINOUS BOWLING BALL

(75) Inventor: Jerry Robb, Kailua Kona, HI (US)

(73) Assignee: Ebonite International, Inc., Hopkinsville, KY (US)

( * ) Notice: Subject to any disclaimer, the term of this patent is extended or adjusted under 35 U.S.C. 154(b) by 0 days.

(21) Appl. No.: 09/425,766

(22) Filed: Oct. 22, 1999

Related U.S. Application Data

(60) Provisional application No. 60/105,523, filed on Oct. 22, 1998.

(51) Int. Cl.[7] ..... A63B 43/06
(52) U.S. Cl. ..... 473/125; 473/570
(58) Field of Search ..... 473/570, 54, 125

(56) References Cited

U.S. PATENT DOCUMENTS 3,580,575 * 5/1971 Speeth .
4,801,141 * 1/1989 Rumsey .
4,848,009 7/1989 Rodgers .
5,102,131 4/1992 Remington et al. .
5,301,955 * 4/1994 Fedullo .
5,343,190 8/1994 Rodgers .
5,500,635 * 3/1996 Mott .
5,725,445 * 3/1998 Kennedy et al. .
5,888,156 * 3/1999 Cmiel et al. .

* cited by examiner

*Primary Examiner*—William M. Pierce
(74) *Attorney, Agent, or Firm*—Cook, Alex, McFarron, Manzo, Cummings & Mehler, Ltd.

(57) ABSTRACT

An impact illuminated bowling ball including a light transmitting core, a pair of LEDs embedded in the core, a piezoelectric transducer embedded in the core and electrically connected to the LEDs. A shock amplifying mechanism in the form of a steel ball is located in operative engagement with the piezoelectric transducer. A rechargeable electric battery in the core is electrically connected to a solar electric collector for recharging. An integrated timing circuit is used to continue illumination during start or stop times when the transducer is actuated by an impact of the bowling ball.

3 Claims, 2 Drawing Sheets

LUMINOUS BOWLING BALL

This application is a continuation of provisional Application Ser. No. 60/105,523 which was filed on Oct. 22, 1998.

BACKGROUND OF THE INVENTION

At the time bowling reached its peak of popularity during the 1960s and 1970s, it had changed very little (ten pins instead of nine) since first played by the ancient Egyptians. However, over the past 15 or so years, the recreational activity of bowling has undergone profound changes.

In terms of organized league bowling, bowlers have abandoned the sport by the millions and bowling alleys have disappeared by the hundreds. The American Bowling Congress, the sanctioning body for men, has seen its membership shrink 50 percent, with the loss of 2.4 million men since 1980. A similar, 51 percent drop in membership (2.1 million women) has been experienced by the Women's International Bowling Congress. At the same time, one in five bowling alleys across the country has closed. Explanations for this decline in interest have been many and varied.

Academics have linked the decline in league bowling to the rise in asocial entertainment, such as video games. Americans no longer find they need to bond in groups, as bowling leagues once allowed them to do. Others say this sport has been hurt by everything from its blue-collar image to the growth of fitness clubs, two-income families, and to various forms of in-home entertainment.

Bowling has also experienced a great technological makeover. In the early 1980s, urethane replaced the more flammable lacquer as the protective coating over the wooden lanes. Less conditioning oil is soaked up by urethane-coated lanes, making them "faster." Since the old hard rubber and plastic-coated balls would not hook well on the new surfaces, they were soon replaced by highly-engineered "reactive" urethane balls.

In the past five years, more and more engineering has been devoted to the placement and action of the internal weight blocks of a bowling ball. Depending upon the mix of urethane and resin, the hardness of the shell, the placement of the weight block, and the angle of the finger grips, a bowling ball can be obtained that "breaks" hard or easy, short or long; one that performs well in oil or another than is better on dryer lanes.

The downside to all of this technology is that bowling balls have gotten expensive—two hundred dollars, and even more, is not an unusual price to pay for a modern bowling ball. As is the case with other sports, such an increase in costs will result in a decrease in the number of younger bowlers (who traditionally have less discretionary income). The long-term catastrophic result of such a trend has not been lost upon bowling equipment manufacturers and bowling alley operators. In addition to changes in semantics and promotional emphasis (bowling centers, not alleys and "channels," not gutters), the world of "cosmic bowling" debuted at a Chicago bowling alley in the summer of 1995.

In bowling centers located throughout the country, as midnight approaches, the lights go out, laser beams flash, smoke machines pump fog, and dance music blasts. Then, the lanes start to shimmer, the pins turn purple, and the balls glow neon pink, orange, and yellow. Bowlers too go through a remarkable transformation, the middle-age bowlers disappear to be replaced by junior high and high school kinds—a crowd that has traditionally not considered bowling to be a wild night on the town.

Unfortunately for bowling center operators, this generational magic comes at a steep capital cost. The requirements to install a new stereo system, smoke machines, laser lights, banks of "black lights", and UV-responsive coatings on pins, balls, and lanes can exceed tens of thousands of dollars. A need thus exists to enable operators of bowling centers to take advantage of this renewed interest in bowling expressed by younger adults by being able to convert their lanes to a "cosmic Bowling"-style without requiring the operator to first invest the significant (and likely unavailable) capital funds required for purchasing and installing expensive equipment.

DESCRIPTION OF THE PREFERRED EMBODIMENT

Figure 1:
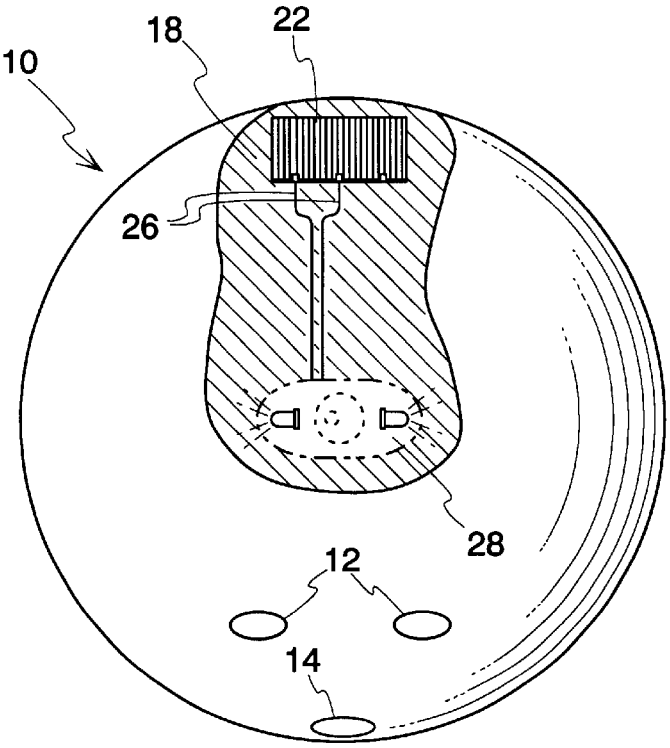
FIG. 1 is a perspective view, with portions broken away, showing an illuminated bowling ball in accordance with the present invention.

Reference is now made to the drawings wherein like numerals refer to like parts throughout. A luminous bowling ball 10 is shown in FIG. 1 of conventional outer design, with a pair of finger holes 12 and a thumb hole 14. Portions of the exterior surface have been shown broken away in FIG. 1, revealing an interior core 18.

A solar cell 22 is shown within the interior core 18 and in close proximity to the surface of the bowling ball 10. A pair of charging wires 26 is attached to the solar cell 22 and extends towards an attachment with a flashing unit 28 that is placed at a location deeper within the interior core 18.

Separation of the flashing unit 28 from the solar cell 22, which is made possible by the charging wires 26, enables two conflicting design criteria to be satisfied. The core material is preferably translucent. Placement of the solar cell close to the surface permits reception of a greater amount of incident light energy. Positioning the flashing unit 28 deeper within the interior core 18 provides a greater amount of internal light diffraction, better illuminating the bowling ball 10.

Figure 2:
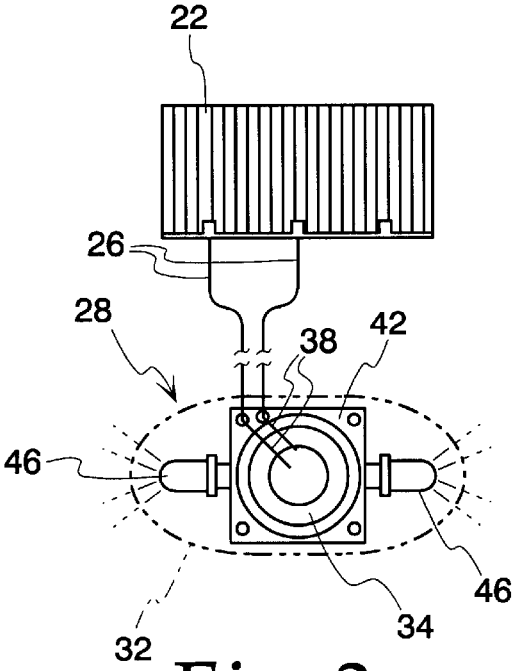
FIG. 2 is an enlarged, top plan view showing a solar cell powering a flashing circuit in accordance with the present invention.

A protective case 32 is shown surrounding the flashing unit 28 in FIG. 2. An electrical storage battery 34 lies within the flashing unit 28 and is in electrical communication with the solar cell 22 through a pair of electrical contacts 38. In a manner discussed hereinafter, electrical current generated by the solar cell 22 is utilized to recharge the electrical storage battery 34.

A support platform 42 is provided within the flashing unit 28 as a member to which the various components are attached. Among such components are a pair of high intensity Light Emitting Diode's (LED's) 46 that project beyond the support platform 42 to provide greater visibility when activated. Visibility is further enhanced, as is shown in FIG. 3, by a pair of visibility portals 52 formed in the protective case 32.

Figure 3:
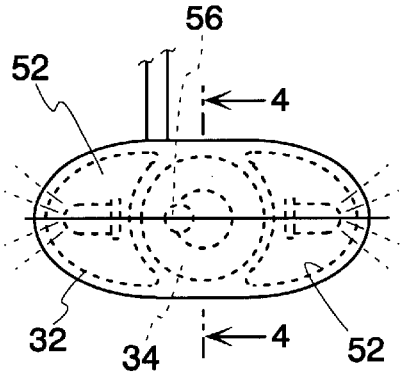
FIG. 3 is an enlarged, bottom plan view showing a flashing circuit in accordance with the present invention.

FIG. 3 also illustrates a presently preferred shock or motion-amplifying system. As noted previously, by positioning the flashing unit 28 deep within the interior core 18 there is a significant refractory enhancement of the light generated upon activation of the flashing unit 28. However, the deeper within the interior core 18, the more attenuated the shock energy that impacts upon the flashing unit 28. In FIG. 3, a hardened steel ball 56 is shown placed within the protective case 32. The steel ball 56 amplifies any shock energy impacting the bowling ball 10 to ensure reliable activation of the flashing unit 28. An example of an activity during which activation of the flashing unit 28 is desired occurs when the bowling ball 10 impacts the lane bed as a player launches the ball on its course towards the pins (not shown in the Figures).

Figure 4:
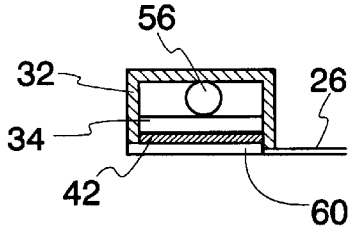
FIG. 4 is a cross sectional view, taken along line 4—4 of FIG. 3, showing a shock-amplifying device in accordance with the present invention.

As depicted in FIG. 4, the protective case 32 forms an enclosed area about the steel ball 56, permitting a limited amount of movement within the protective case 32. The inertial characteristics of the steel ball 56 result in a somewhat lagging response to the quick movements associated with shock impact of the outer bowling ball 10. This delay in turn causes the steel ball 56 to generate a second impact that is primarily "felt" by the flashing unit 28, resulting in the activation thereof.

In the presently preferred embodiment, a piezoelectric transducer is the apparatus utilized to initiate the flashing of the LEDs 46. Such a transducer will generate a voltage in response to a mechanical stress, such as those caused by shock and/or vibration. Piezoelectric transducers are well known. An inexpensive type that is used with some frequency for other applications is a piezoceramic made from either barium titanate or lead zirconate titanate.

Figure 5:
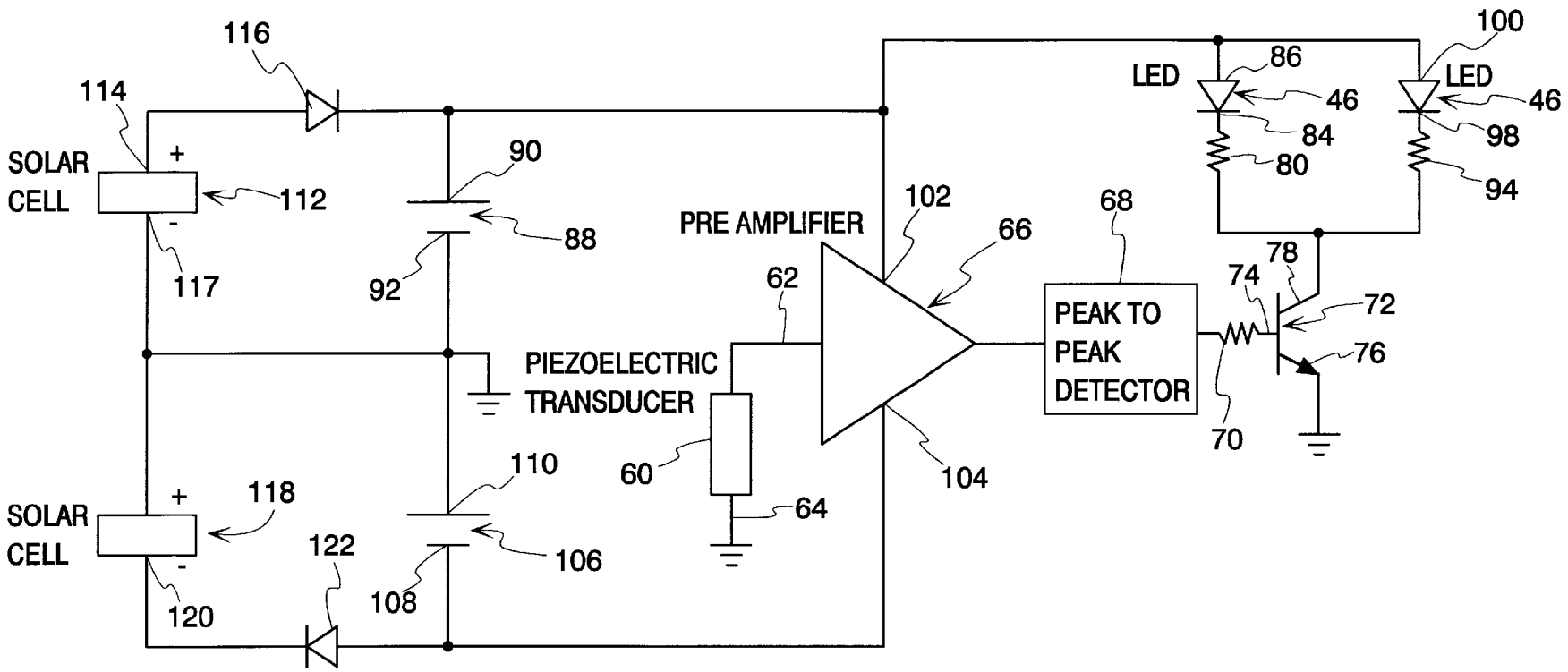
FIG. 5 is a schematic diagram of a flashing circuit in accordance with the present invention.

As shown in FIG. 5, a piezoceramic transducer 60 has a pair of output signal lines 62, 64, that are respectively connected to an amplifier 66 at a signal input thereof and to ground. In response to a mechanical stress, the transducer 60 provides a voltage to the input of the amplifier 66.

The amplifier 66 has a high input impedance. As a result, the amplitude of the transducer voltage provided to the amplifier 66 is substantially equal to the amplitude of the open circuit transducer voltage. Additionally, the amplifier 66 has a unity voltage gain and an output impedance that is sufficiently low to make it suitable for driving other electrical circuit elements. Because of the unity voltage gain, the amplifier output voltage is similar to the transducer voltage provided to the input of the amplifier 66. Also, the transducer 60 is electrically a capacitor. Hence, the transducer voltage and the amplifier output voltage have an average value of zero. In other words, neither the transducer voltage nor the amplifier output voltage have a DC component.

The output of the amplifier 66 is connected to a peak-to-peak detector 68. In response to the amplifier output voltage, the detector 68 provides a unipolar positive voltage substantially equal in amplitude to the peak-to-peak amplitude of the amplifier output voltage.

The output of the detector 68 is connected through a resistor 70 to an NPN transistor 72 at its base 74. An emitter 76 of the transistor 72 is connected to ground. The purpose of the resistor 70 is to limit the magnitude of a base current that can be provided to the transistor 72.

A collector 78 of the transistor 72 is connected through a resistor 80 to a light generator. In this embodiment, the light generator is the light emitting diode (LED) 46. More particularly, the connection through the resistor 80 is to a cathode 84 of the LED 46. An anode 86 of the LED 46 is connected to a battery 88 at a positive pole 90. A negative pole 92 of the battery 88 is connected to ground. In this embodiment, the battery 88 provides 1.5 volts.

In a similar manner, the collector 78 is connected through a resistor 94 to an LED 46 at a cathode 98 thereof. An anode 100 of the LED 46 is connected to the positive pole 90. The resistors 80, 94 are of equal resistance.

In response to a positive voltage provided by the peak-to-peak detector 68, current from the battery 88 flows through the pair of LEDs 46 and the pair of resistors 80, 94 to ground via the NPN transistor 72. The purpose of the pair of resistors 80, 94 is to limit and substantially equalize currents through the pair of LEDs 46.

The positive pole 90 is additionally connected to a positive voltage input 102 of the amplifier 66. A negative voltage input 104 of the amplifier 66 is connected to a second battery 106 at a negative pole 108 thereof. A positive pole 110 of the second battery 106 is connected to ground. Hence, the pair of batteries 88, 106 are positive and negative power sources for the amplifier 66. In this embodiment, the first battery 88 is similar to the second battery 56.

Preferably, a solar cell 112 has a positive pole 114 connected to a diode 116 at its anode. A negative pole 117 of the solar cell 112 is connected to ground. As known to those skilled in the art, a solar cell provides a voltage in response to incident light. Since the bowling ball is made from a translucent resin, the solar cell 112 receives incident light that causes it to provide a voltage.

The cathode of the diode 116 is connected to the positive pole 90. Whenever the voltage provided by the solar cell 112 is greater than the voltage provided by the battery 88, the solar cell 112 charges the battery 88. The diode 116 prevents the battery 88 from discharging through the solar cell 112.

Similarly, a second solar cell 118 has a negative pole 120 connected to a diode 122 at its cathode. A positive pole 124 of the solar cell 118 is connected to ground. The anode of the diode 122 is connected to the negative pole 108. Whenever the voltage provided by the second solar cell 118 is greater than the voltage provided by the battery 106, the second solar cell 118 charges the battery 106. The diode 122 prevents the battery 106 from discharging through the second solar cell 118.

In a preferred embodiment, the luminous bowling ball 10 is fabricated using a bowling ball similar to the "Amulet" model manufactured by Visionary Bowling Products of Jennings, Mo., or the "Clear Wolf" bowling ball, manufactured by Ebonite International of Hopkinsville, Ky., with the flashing device molded into the ball during its manufacture. The solar cells can be of a type that provide 3 volts D.C., such as the Silicon Solar Cell, Model No. 276-1244 sold by Radio Shack (Tandy Corporation) of Fort Worth, Tex. To obtain reliable and sufficient power, installation of the solar cells is preferably ½" (approximately) from the surface of the bowling ball.

The power source for the flashing unit is a 3-volt D.C. Nicad Rechargeable battery, such as battery number 23292 as sold by Radio Shack (Tandy Corporation) of Fort Worth, Tex. The flashing unit itself includes preferably two high-intensity LEDs, such as Model No. 2761622 sold by Radio Shack, or one or more taken from a sequence of color models, such as Model No. 92N5330 MCL934MBC (Blue) by Newark Electronics of Chicago, Ill. Such LEDs are manufactured in a variety of colors. Red, green, and blue are considered to be especially appropriate for use in the present invention. A flashing circuit such as membrane switch No. 04F1071 MCS12411208, also manufactured by Newark Electronics of Chicago is of the type presently preferred for use in the present invention, with a piezo crystal, such as piezo crystal No. 16F1869 12412501 sold by Newark Electronics of Chicago, Ill. useful for triggering the flashing circuit.

To continue the sequence of flashing of the LEDs 46 after an impact of the bowling ball on the lane or an impact of the ball with the pins, a timing circuit (preferably an integrated circuit), such as that shown in FIG. 5 of U.S. Pat. No. 4,848,009 may be used to control illumination duration start or stop times when illumination is called for after the piezoelectric transducer 60 is actuated by an impact of the bowling ball. This timing circuit may be incorporated in the circuit of FIG. 5 or substituted therefor. Additional LEDs, such as the nine LEDs shown in U.S. Pat. No. 4,848,009, may be incorporated in the circuit of my bowling ball. U.S. Pat. No. 4,848,009 is incorporated by reference in this application for all purposes.

My invention has been disclosed in terms of a preferred embodiment thereof, which provides an improved luminescent bowling ball that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. An impact illuminated bowling ball comprising:

a light transmitting core, at least one light embedded in said light transmitting core, at least one piezoelectric transducer embedded in said core and electrically connected to said at least one light, and a steel ball shock amplifying mechanism operatively connected to said piezoelectric transducer.

2. The impact illuminated bowling ball of claim 1 in which said light is a LED.

3. The impact illuminated bowling ball of claim 1 in which said piezoelectric transducer is positioned against a side of said electric battery and said shock amplifying mechanism is positioned against an opposite side of said battery.

* * * * *